US011805917B2

(12) United States Patent
Wu

(10) Patent No.: US 11,805,917 B2
(45) Date of Patent: Nov. 7, 2023

(54) CHAIR BASE

(71) Applicant: COMFORDY CO., LTD., Taipei (TW)

(72) Inventor: Yu-Ling Wu, Tainan (TW)

(73) Assignee: Comfordy Co., Ltd., Tainan (TW)

( * ) Notice: Subject to any disclaimer, the term of this patent is extended or adjusted under 35 U.S.C. 154(b) by 0 days.

(21) Appl. No.: 17/655,392

(22) Filed: Mar. 18, 2022

(65) Prior Publication Data

US 2023/0292927 A1 Sep. 21, 2023

(51) Int. Cl.
*A47C 9/00* (2006.01)
*A47C 3/029* (2006.01)

(52) U.S. Cl.
CPC ..... *A47C 9/002* (2013.01); *A47C 3/029* (2013.01)

(58) Field of Classification Search
CPC ..... A47C 3/029; A47C 9/002
USPC ..... 297/270.1, 270.5, 271.5, 451.4
See application file for complete search history.

(56) References Cited

U.S. PATENT DOCUMENTS

| | | | | |
|---|---|---|---|---|
| 2,038,806 | A * | 4/1936 | Sellar | A47C 9/025 248/407 |
| 8,407,855 | B2 * | 4/2013 | Gagnon | A47B 91/00 248/188.9 |
| 8,764,116 | B2 * | 7/2014 | Weber | A47C 9/002 297/423.43 |
| 8,998,319 | B2 * | 4/2015 | Bahneman | A47C 9/00 297/214 |
| 9,931,556 | B2 * | 4/2018 | Cosma | A63B 69/04 |
| 10,258,160 | B2 * | 4/2019 | Risdall | A47C 3/04 |
| 2007/0182101 | A1 * | 8/2007 | Chiu | A63B 5/16 273/449 |

* cited by examiner

*Primary Examiner* — Sarah B McPartlin
(74) *Attorney, Agent, or Firm* — Rosenberg. Klein & Lee

(57) ABSTRACT

A chair base is revealed. A round bulge is formed on a center of a bottom surface of a bottom plate and a limit portion is gradually flattened from the round bulge toward a periphery of the bottom plate. A base body is disposed on a top surface of the bottom plate while a cover is used for covering the base body therein and enclosing the periphery of the bottom plate. Thereby the bottom plate, the base body, and the cover are connected and fixed by one another. While in use, users rock the chair by the round bulge on the bottom plate in response to their shifts in center of gravity. A rock angle of the chair is limited by the limit portion. Thereby the users will not tip the chair over while rocking the chair violently and safety in use is ensured.

6 Claims, 6 Drawing Sheets

CHAIR BASE

BACKGROUND OF THE INVENTION

Field of the Invention

The present invention relates to a chair, especially to a chair base by which a rock angle of a chair is limited.

Description of Related Art

A rockable chair available now mainly includes a curved bottom plate arranged at a bottom of a chair base or leg. While sitting on the chair, users can rock the chair by the bottom plate in response to shifts in center of gravity in order to move their bodies and avoid fatigue and damages caused by keeping the same sitting posture for a long time. However, the rockable chair available now lacks a design which limits a rock angle of the chair within a safe range. While in use, users may rock the chair as much as they like and tip the chair over, then fall on the ground and get injuries. Thus there is a safety issue while sitting on the chair and there is room for improvement.

SUMMARY OF THE INVENTION

Therefore, it is a primary object of the present invention to provide a chair base by which a rock angle of a chair is able to be limited to avoid chair tip-overs and falls from the chair.

In order to achieve the above angle, a chair base according to the present invention includes a bottom plate, a base body and a cover. A round bulge is disposed on a center of a bottom surface of the bottom plate and a limit portion is gradually flattened from the round bulge toward a periphery of the bottom plate. The base body is disposed on a top surface of the bottom plate while the cover is used for covering the base body therein and enclosing the periphery of the bottom plate. Thereby the bottom plate, the base body, and the cover are connected and fastened with one another. While in use, users rock the chair by the round bulge on the bottom plate in response to shifts in the center of gravity. As to the limit portion around the round bulge of the bottom plate, it is used to limit a rock or title angle of the chair for preventing users from falling over due to chair tip-over when they rock the chair and tilt the chair too much. The safety of the chair in use is further ensured.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
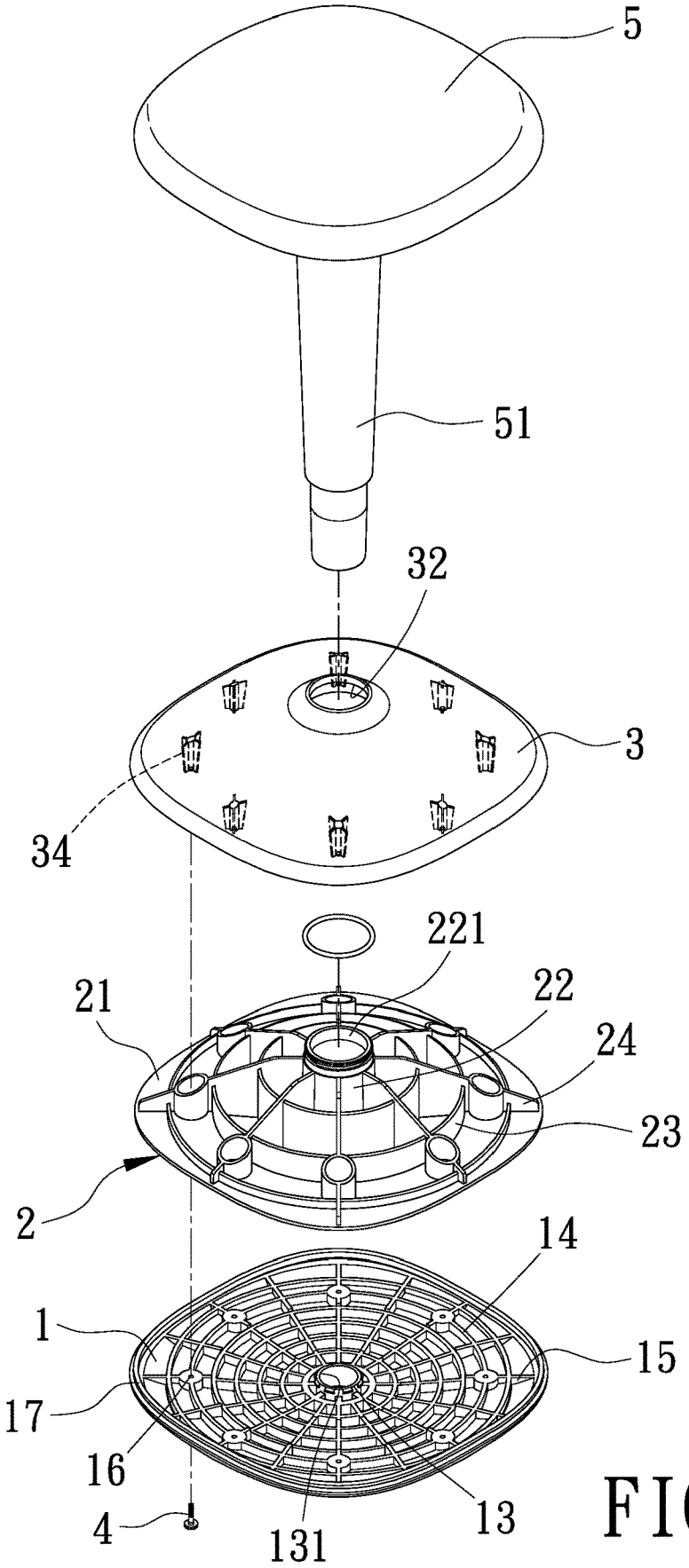
FIG. 1 is an exploded view of a chair with an embodiment according to the present invention.
Figure 2:
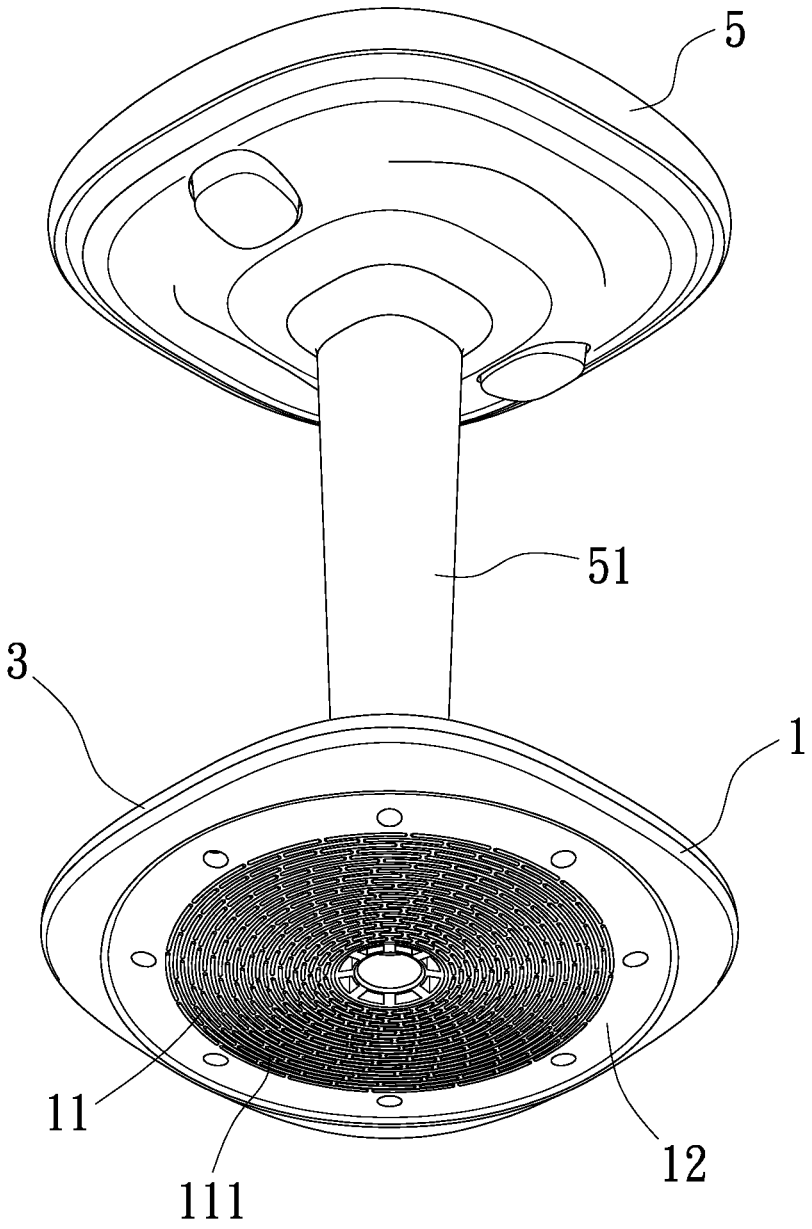
FIG. 2 is a perspective view of a chair with an embodiment according to the present invention.

Refer to FIG. 1-4, a chair base according to the present invention includes a bottom plate 1, a base body 2, and a cover 3.

The bottom plate 1 which is having a top surface and a bottom surface opposite to each other is provided with a round bulge 11 formed on a center of the bottom surface of the bottom plate 1, a limit portion 12 which is gradually flattened from the round bulge 11 toward a periphery of the bottom plate 1, an assembly rod 13 disposed on a center of the top surface of the bottom plate 1 and provided with a through hole 131 formed at a center of the assembly rod 13, a plurality of circular first reinforcement ribs 14 with increasing diameters arranged at the top surface of the bottom plate 1 from the center of the top surface of the bottom plate 1 in a concentric manner, a plurality of second reinforcement ribs 15 disposed radially on the top surface of the bottom plate 1 and extended from the assembly rod 13 to the periphery of the bottom plate 1, a plurality of first fastening holes 16 mounted to the limit portion 12, and a locking portion 17 disposed on a periphery of the top surface of the bottom plate 1. A plurality of circular anti-slip strips 111 with increasing diameters is arranged at the round bulge 11 from a center of the round bulge 11 in a concentric manner. The first reinforcement ribs 14 and the second reinforcement ribs 15 are crossed and connected with each other. The locking portion 17 includes a first locking groove 171 and a second locking groove 172 respectively formed on an inner side and an outer side thereof.

The base body 2 is located on the top surface of the bottom plate 1 and composed of an assembly plate 21 with a top surface and a bottom surface opposite to each other, a sleeve 22 formed on a center of the top surface of the assembly plate 21 and provided with a mounting hole 221 on a center of the sleeve 22 for mounted and connected with the assembly rod 13 on the top surface of the bottom plate 1, a plurality of circular first support ribs 23 with increasing diameters disposed on the top surface of the assembly plate 21 from the center of the top surface of the assembly plate 21 in a concentric manner, a plurality of second support ribs 24 arranged at the top surface of the assembly plate 21 and radially extended from the sleeve 22 toward a periphery of the assembly plate 21, and a plurality of second fastening holes 25 disposed on the assembly plate 21 of the base body 2 and corresponding to the plurality of the first fastening holes 16 of the bottom plate 1. A height of the respective concentric circular first support ribs 23 is decreasing from the center to a periphery of the top surface of the assembly plate 21. The first support ribs 23 and the second support ribs 24 are crossed and connected with each other. The periphery of the assembly plate 21 is locked in and connected with the first locking groove 171 on the inner side of the locking portion 17.

Figure 3:
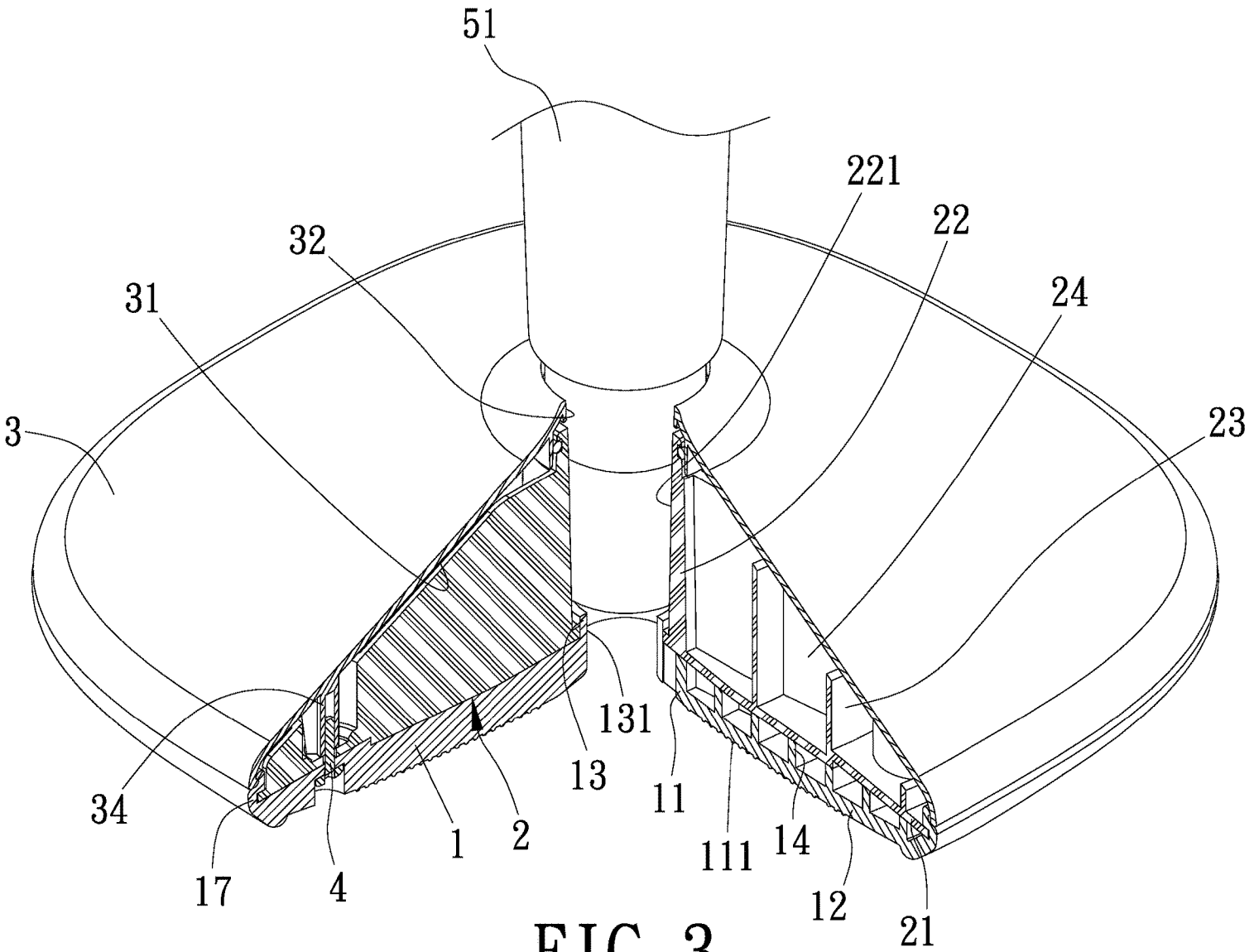
FIG. 3 is a cutaway view of an embodiment of a chair base according to the present invention.
Figure 4:
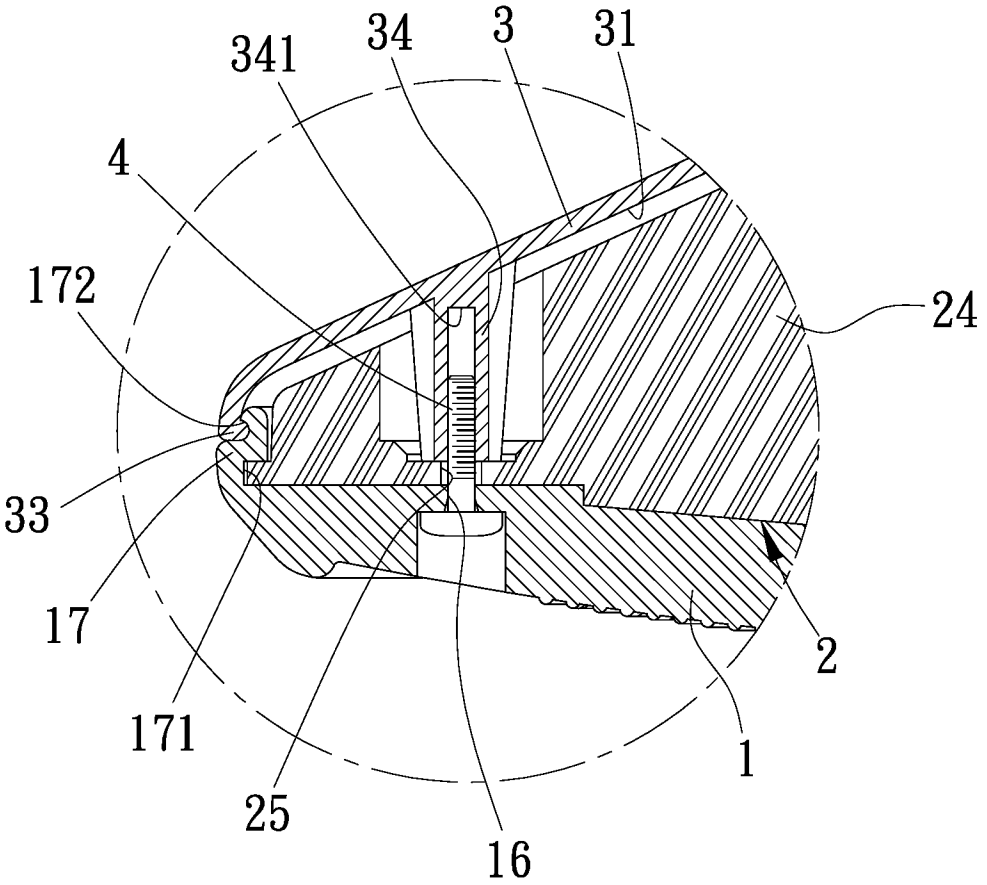
FIG. 4 is an enlarged partial sectional view of an embodiment of a chair base according to the present invention.

Refer to FIG. 3 and FIG. 4, the cover 3 consists of a covering cavity 31 which is used for covering the base body 2 therein and enclosing the periphery of the bottom plate 1, an insertion hole 32 arranged at the center of the cover 3 and aligned with the mounting hole 221 of the sleeve 22 of the base body 2, at least one locking flange 33 which is mounted to an edge of a bottom surface of the covering cavity 31 of the cover 3 for locked in and connected with the second locking groove 172 on the outer side of the locking portion 17, and a plurality of fixing pins 34 which is arranged at the covering cavity 31 of the cover 3, corresponding to the second fastening holes 25 of the base body 2, and provided with a plurality of third fastening holes 341 correspondingly. A plurality of fasteners 4 is provided and inserted through the first fastening holes 16 of the bottom plate 1, the second fastening holes 25 of the base body 2, and the third fastening holes 341 of the cover 3 correspondingly for fastening and connecting the bottom plate 1, the base body 2, and the cover 3.

While being assembled, the base body 2 is placed over the bottom plate 1 and the assembly rod 13 at the center of the bottom plate 1 is mounted into and connected with the mounting hole 221 of the sleeve 22 at the center of the base body 2 correspondingly. Then the periphery of the of the assembly plate 21 of the base body 2 is locked in and connected with the first locking groove 171 on the inner side of the locking portion 17 of the bottom plate 1. The base body 2 is aligned with and covered by the covering cavity 31 of the cover 3. Then the locking flange 33 on the edge of the bottom surface of the covering cavity 31 of the cover 3 is locked and connected with the second locking groove 172 on the outer side of the locking portion 17 of the bottom plate 1 correspondingly. Next the fasteners 4 are inserted through the first fastening holes 16 of the bottom plate 1, the second fastening holes 25 of the base body 2, and the third fastening holes 341 of the cover 3 correspondingly to fasten and connect the bottom plate 1, the base body 2, and the cover 3. Thereby the assembly of the chair base has been completed. Later a central rod 51 of a chair seat 5 is inserted through the insertion hole 32 located at the center of the cover 3 and then mounted and connected to the mounting hole 221 on the sleeve 22 of the base body 2, as shown in FIG. 1 and FIG. 3.

Figure 5:
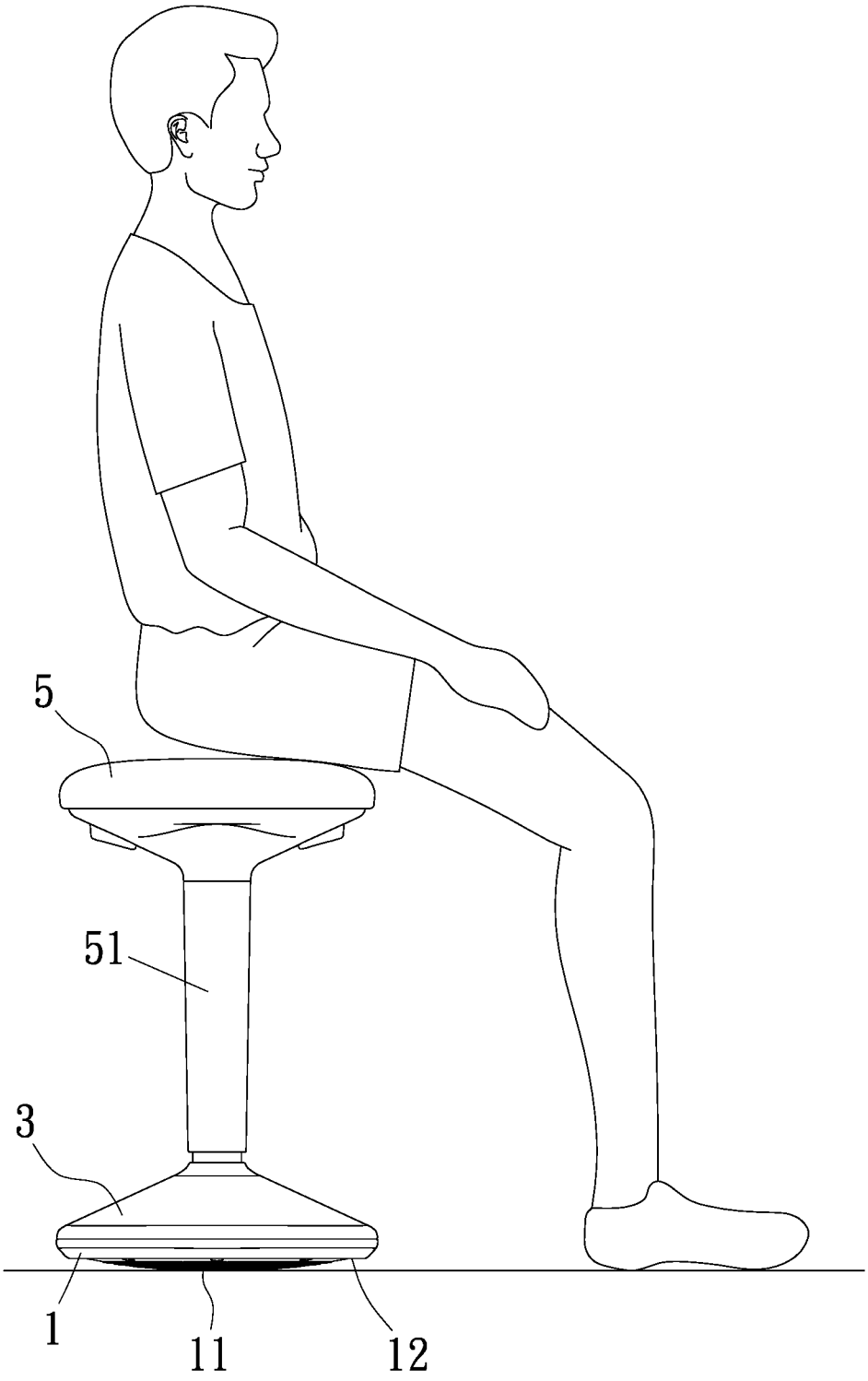
FIG. 5 is a schematic drawing showing a chair with an embodiment in use according to the present invention.
Figure 6:
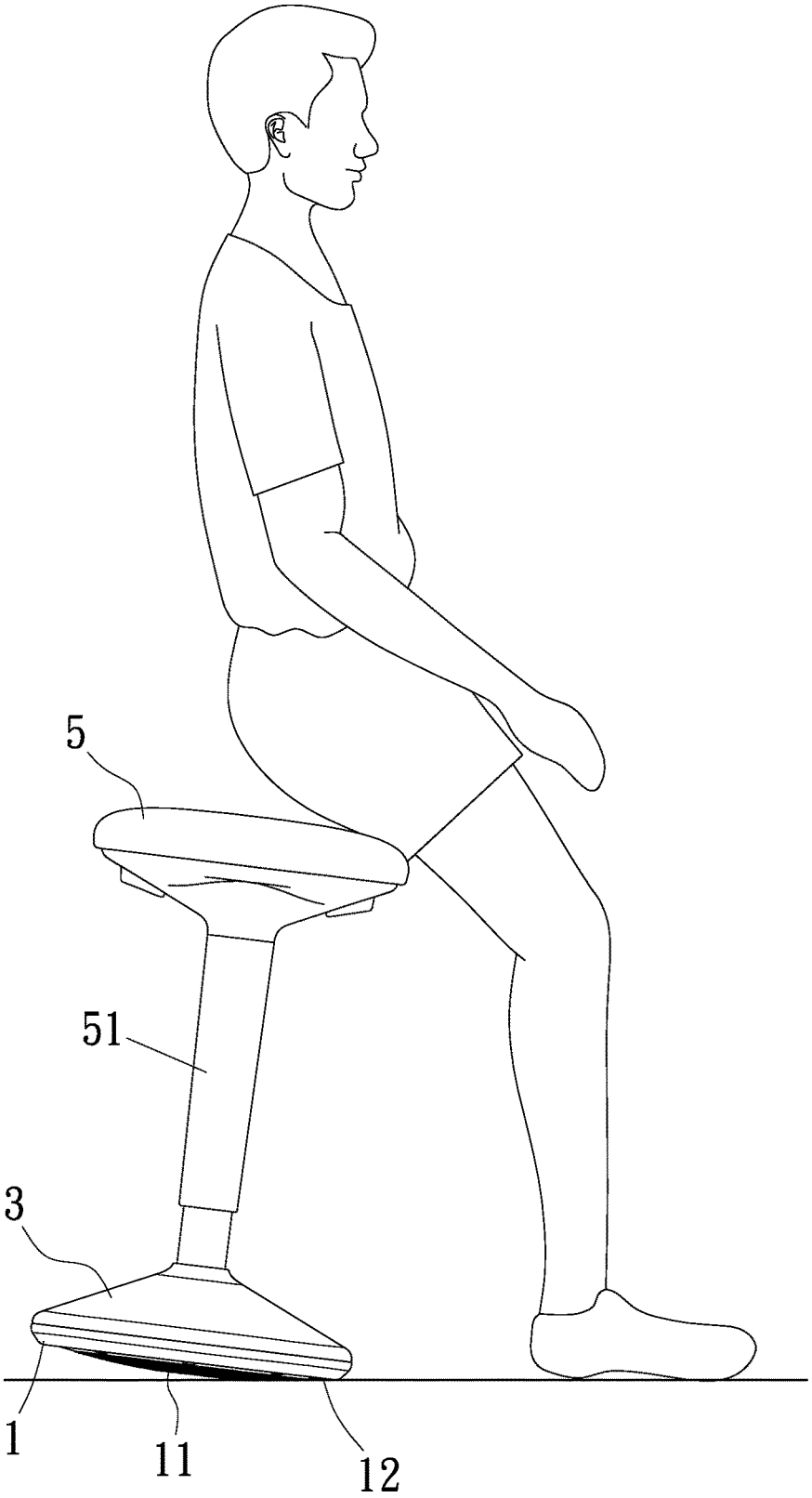
FIG. 6 is another schematic drawing showing a chair with an embodiment in use according to the present invention.

Refer to FIG. 5 and FIG. 6, while a user is sitting on a chair with the present chair base, the user rocks the chair by the design of the round bulge 11 on the center of the bottom surface of the bottom plate 1 in response to shifts in the center of gravity to move the body and train the muscles. Thus physical fatigue and injuries caused by sitting in the same posture for a long time can be avoided. Moreover, a rock or tilt angle of the chair can be limited by the gradually-flattened limit portion 12 around the periphery of the round bulge 11 on the bottom surface of the bottom plate 1. The limit portion 12 protects the user from falling on the ground when he/she rocks the chair harder and tip the chair over. Thereby safety in use is ensured. The round bulge 11 grips the ground well by the circular anti-slip strips 111 on the bottom surface thereof of the bottom plate 1 while the user rocks the chair back and forth. Thus the chair is more stable during the rocking. Both the first reinforcement ribs 14 and the second reinforcement ribs 15 are formed on the top surface of the bottom plate 1. The arrangement of the first reinforcement ribs 14 and the second reinforcement ribs 15 further increases structural strength of the bottom plate 1 so that a service life of the present chair base is improved.

In summary, the present invention has the following advantages:

1. The limit portion is arranged around the round bulge on the center of the bottom surface of the bottom plate and used to limit the rock angle of the chair. Thereby users will not fall over due to chair tip-over when they rock the chair and tilt the chair too much. The safety in use is further ensured.
2. The round bulge grips the ground well by the circular anti-slip strips on the bottom surface thereof of the bottom plate while the user rocks the chair back and forth. Thus the chair is more stable during the rocking.
3. The plurality of reinforcement ribs is mounted to the top surface of the bottom plate to increase structural strength of the bottom plate. Thereby service life of the bottom plate is extended.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A chair base comprising:

a bottom plate having a top surface and a bottom surface opposite to each other and is provided with a round bulge formed on a center of the bottom surface of the bottom plate, and a limit portion gradually flattened from the round bulge toward a periphery of the bottom plate;

a base body located on the top surface of the bottom plate and including an assembly plate with a top surface and a bottom surface opposite to each other, and a sleeve formed on a center of the top surface of the assembly plate and provided with a mounting hole;

a cover having a covering cavity used for covering the base body therein and enclosing the periphery of the bottom plate, and an insertion hole arranged at a center of the cover and aligned with the mounting hole of the sleeve of the base body; wherein the bottom plate, the base body, and the cover are connected and fixed by one another;

a locking portion disposed on a periphery of the top surface of the bottom plate and provided with a locking groove formed on an outer side of the locking portion; and at least one locking flange mounted to an edge of a bottom surface of the covering cavity of the cover is locked in and connected with the locking groove on the locking portion of the bottom plate.

2. The chair base as claimed in claim 1, wherein a plurality of circular anti-slip strips with increasing diameters is arranged at the round bulge of the bottom plate from a center of the round bulge in a concentric manner.

3. The chair base as claimed in claim 1, wherein an assembly rod is disposed on a center of the top surface of the bottom plate and provided with a through hole formed at a center of the assembly rod; the mounting hole of the sleeve of the base body is mounted and connected with the assembly rod of the bottom plate correspondingly.

4. The chair base as claimed in claim 1, wherein a plurality of circular first support ribs with increasing diameters is disposed on the top surface of the assembly plate from the center of the top surface of the assembly plate in a concentric manner and a height of each of the circular first support rib is decreasing from the center to a periphery of the top surface of the assembly plate; a plurality of second support ribs is arranged at the top surface of the assembly plate and radially extended from the sleeve toward a periphery of the assembly plate; the first support ribs and the second support ribs are crossed and connected with each other.

5. The chair base as claimed in claim 1, wherein the locking portion includes another locking groove formed on an inner side of the locking portion; a periphery of the assembly plate is locked in and connected with the other locking groove on the locking portion of the bottom plate.

6. The chair base as claimed in claim 1, wherein a plurality of first fastening holes is mounted to the limit portion of the bottom plate while a plurality of second fastening holes is disposed on the assembly plate of the base body and corresponding to the first fastening holes of the bottom plate; a plurality of fixing pins is arranged at the covering cavity of the cover, corresponding to the second fastening holes of the base body, and provided with a plurality of third fastening holes; wherein a plurality of fasteners are provided and inserted through the first fastening holes of the bottom plate, the second fastening holes of the base body, and the third fastening holes of the cover correspondingly to fasten and connect the bottom plate, the base body, and the cover.

* * * * *